US006447241B2

(12) United States Patent
Nakao

(10) Patent No.: US 6,447,241 B2
(45) Date of Patent: Sep. 10, 2002

(54) METHOD AND APPARATUS FOR EXPANDING OPERATING RANGE OF CENTRIFUGAL COMPRESSOR

(75) Inventor: Hidefumi Nakao, Kiyose (JP)

(73) Assignee: Ishikawajima-Harima Jukogyo Kabushiki Kaisha, Tokyo-to (JP)

( * ) Notice: Subject to any disclaimer, the term of this patent is extended or adjusted under 35 U.S.C. 154(b) by 0 days.

(21) Appl. No.: 09/802,917

(22) Filed: Mar. 12, 2001

(30) Foreign Application Priority Data

Apr. 7, 2000 (JP) ..... 2000-106855

(51) Int. Cl.[7] ..... F04D 29/44

(52) U.S. Cl. ..... 415/1; 415/11; 415/58.4; 415/205; 415/206; 415/914

(58) Field of Search ..... 415/1, 11, 58.2, 415/58.3, 58.4, 116, 184, 205, 206, 914

(56) References Cited

U.S. PATENT DOCUMENTS 4,930,978 A * 6/1990 Khanna et al. ..... 415/58.3
5,246,335 A * 9/1993 Mitsubori et al. ..... 415/58.3
5,863,178 A * 1/1999 Scheinert et al. ..... 415/58.4

FOREIGN PATENT DOCUMENTS

JP 5-60097 3/1993
JP 06147195 A * 5/1994 ..... F04D/29/42

* cited by examiner

*Primary Examiner*—Edward K. Look
*Assistant Examiner*—Ninh Nguyen
(74) *Attorney, Agent, or Firm*—Oblon, Spivak, McClelland, Maier & Neustadt, P.C.

(57) ABSTRACT

In a centrifugal compressor, a housing is provided which has an annular treatment cavity in a shroud wall. The shroud wall has a first opening providing communication between an installed zone of an impeller and the treatment cavity, and a second opening providing communication between the treatment cavity and a zone upstream of the first opening so as to circulate air a during a low-flow-rate operation. Louvers are arranged in the second opening in circumferentially equidistantly spaced apart relationship with each other and inclined reversely to a rotative direction of the impeller so that the air a sucked to the treatment cavity is, when discharged through the second opening, subjected to directional flow guide action with a whirling direction reverse to the rotative direction of the impeller.

4 Claims, 7 Drawing Sheets

METHOD AND APPARATUS FOR EXPANDING OPERATING RANGE OF CENTRIFUGAL COMPRESSOR

BACKGROUND OF THE INVENTION

1. Field of the Invention

The present invention relates to a method and apparatus for expanding an operating range of a centrifugal compressor which is, for example, used as an air feeder to a turbocharger for supercharging an engine or used as an air supply in an ordinary manufacturing plant or used together with a gas turbine.

2. Discussion of the Background

Conventionally, a turbocharger for supercharging an engine may comprise a turbine with a vane wheel, a centrifugal compressor with an impeller and a bearing casing which integrally connects the turbine to the centrifugal compressor. The vane wheel is connected to the impeller through a shaft rotatably supported in the bearing casing and is rotated by exhaust gases from the engine to rotate the impeller via the shaft. Thus, intake air is compressed by the centrifugal compressor and supplied to the engine.

A centrifugal compressor for use with a turbocharger of the type described above has a characteristic such that, as shown in FIG. 1, compressor's characteristic curves I may exceed a surge line S into a surging region X of lower flow rate. Therefore, if the surge line S can be successfully shifted to position S' where the flow rate is lower, the centrifugal compressor can be applied in a wider or expanded operating range to the engine.

A conventional proposal in this connection is disclosed for example in JP-A-05-060097 (Japanese Patent No. 3038398). It is directed to, as shown in FIGS. 2A and 2B, a centrifugal compressor of the type wherein a housing 6 has a shroud wall 5 to provide a scrolled compression duct 3 on an outer periphery of an impeller 1 via a diffuser 2, the shroud wall 5 extending ahead of the diffuser 2 to provide an air inlet 4, and wherein a vane wheel (not shown) of a turbine is connected via a shaft to the impeller 1 and is rotated by exhaust gases from an engine to rotate the impeller 1 via the shaft, whereby intake air is compressed and supplied to the engine. The apparatus comprises: a throttle portion 7 on the shroud wall 5 adjacent to the air inlet 4 and convergent toward the impeller 1 such that air a is throttled by the throttle portion 7 and sucked through the impeller 1; an annular treatment cavity 8 in the shroud wall 5; and circumferentially extending, first and second slots or openings 9 and 10 on the shroud wall 5, the first opening 9 providing communication between the treatment cavity 8 and an impeller-side portion of the air inlet 4 or portion of the air inlet 4 adjacent to the impeller 1, the second opening 10 providing communication between the treatment cavity 8 and a portion of the air inlet 4 located somewhat ahead of the impeller-side portion of the air inlet 4, i.e., somewhat behind an end of the throttle portion 7. Thus, the first opening 9, treatment cavity 8 and second opening 10 provide a mechanism for expanding the operating range by which, during a low-flow-rate operation, part of the air a sucked by the impeller 1 is circulated to attain reduction of the flow rate in terms of the surge line.

In operation of the conventional centrifugal compressor, the air a is sucked through the air inlet 4 by rotation of the impeller 1 into a suction zone of the impeller 1 and is supplied through the compression duct 3 to a target zone. During a low-flow-rate operation, the air a which has flowed into the impeller 1 is increased in pressure due to the action of the impeller 1 so as to have high pressure in comparison with the air inlet 4 and treatment cavity 8, so that part of the air a having passed through blades of the impeller 1 can be fed through the first opening 9 and treatment cavity 8 and discharged through the second opening 10 back to the impeller 1. In this manner, air flow circulation can be attained through the use of static pressure.

As described above, in the prior structure, part of the air a sucked by the impeller 1 can be circulated so that entering into the surging region can be successfully avoided even under the operating condition where the flow rate is so low as to reach the surging region. In other words, the surge line S shown in FIG. 1 can be shifted into the position S' where the flow rate is low.

In the above-described centrifugal compressor, however, the air a circulated via the first opening 9, treatment cavity 8 and second opening 10 into the impeller 11 has flow direction as shown in FIG. 2B aligned with the rotative direction (as indicated by arrow r) of the impeller 1 or flows in so-called forward direction to the rotation of the impeller 1. Thus, as compared with a case where the air a is not circulated, expansion of the operating range may be indeed achieved. However, turning of the flow angle between before and after the impeller 1 is so small that inconveniently decreased is the Euler head which is pressure ratio between entry and exit sides of the impeller 1.

BRIEF SUMMARY OF THE INVENTION

An object of the present invention is, therefore, to achieve expansion of an operating range of a centrifugal compressor of the type as described above with no decrease in the Euler head.

The invention was made to solve the above problem.

According to one aspect of the invention, there is provided a method for expanding an operating range of a centrifugal compressor, the centrifugal compressor including a shroud wall extending ahead of an outer periphery of an impeller to provide an air inlet, an annular treatment cavity in the shroud wall and first and second openings on the shroud wall, the first opening providing communication between the treatment cavity and an impeller-side portion of the air inlet, the second opening providing communication between the treatment cavity and a portion of the air inlet located somewhat ahead of the impeller-side portion of the air inlet, wherein, during a low-flow-rate operation, part of the air sucked through the impeller is fed through the first opening into the treatment cavity and is discharged through the second opening so as to be circulated. The method comprises discharging the air, which has flowed through the first opening into the treatment cavity, through the second opening as flow having a direction within a range from a direction with no whirling component to a whirling direction reverse to or conflicting with the rotative direction of the impeller. According to another aspect of the invention, there is provided an apparatus for expanding an operating range of a centrifugal compressor, the centrifugal compressor including a shroud wall extending ahead of an outer periphery of an impeller to provide an air inlet, an annular treatment cavity in the shroud wall and first and second openings on the shroud wall, the first opening providing communication between the treatment cavity and an impeller-side portion of the air inlet, the second opening providing communication between the treatment cavity and a portion of the air inlet located somewhat ahead of the impeller-side portion of the air inlet, wherein, during a low-flowrate operation, part of the air sucked through the impeller is fed through the first opening to the treatment cavity and is discharged through the second opening so as to be circulated. The apparatus comprises a number of louvers arranged in the second opening of the shroud wall, angular arrangement of the louvers being within a range from a radial arrangement to an arrangement inclined reversely to the rotative direction of the impeller.

During the low-flow-rate operation, the air fed through the first opening into the treatment cavity is, when passed through the second opening, guided by the louvers so that it is discharged as flow having a direction within a range from a direction with no whirling component to a whirling direction reverse to the rotative direction of the impeller. This prevents a decrease in the Euler head.

Instead of the louvers in the second opening, a number of guide plates may be arranged in the treatment cavity, an angular arrangement of the guide plates being within a range from radial arrangement to arrangement inclined reversely to the rotative direction of the impeller. In this structure, the flow in the treatment cavity is restricted by the guide plates each having a larger area than the louver, thereby providing directional flow guide action within a range from a direction with no whirling component to a whirling direction reverse to the rotative direction of the impeller. As a result, discharged through the second opening is the air with strong directivity not aligned with the rotative direction of the impeller.

Alternatively, guide plates may be arranged in the treatment cavity as if to be extended from their corresponding louvers. This allows the air sucked into the treatment cavity to be subjected to the directional flow guide action exerted by the guide plates and by the louvers. As a result, the air is discharged through the second opening with strong directivity not aligned with the rotative direction of the impeller.

DESCRIPTION OF THE PREFERRED EMBODIMENTS

Figure 2A:
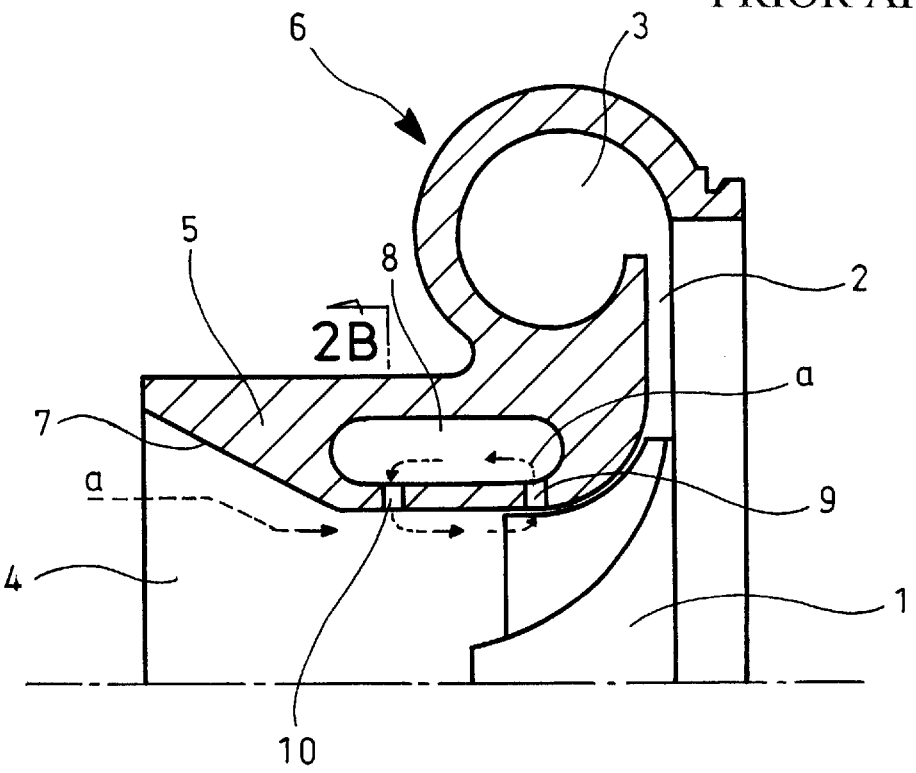
FIG. 2A PRIOR ART
FIG. 2A is a schematic fragmentary sectional side elevation, of a conventional centrifugal compressor.
Figure 2B:
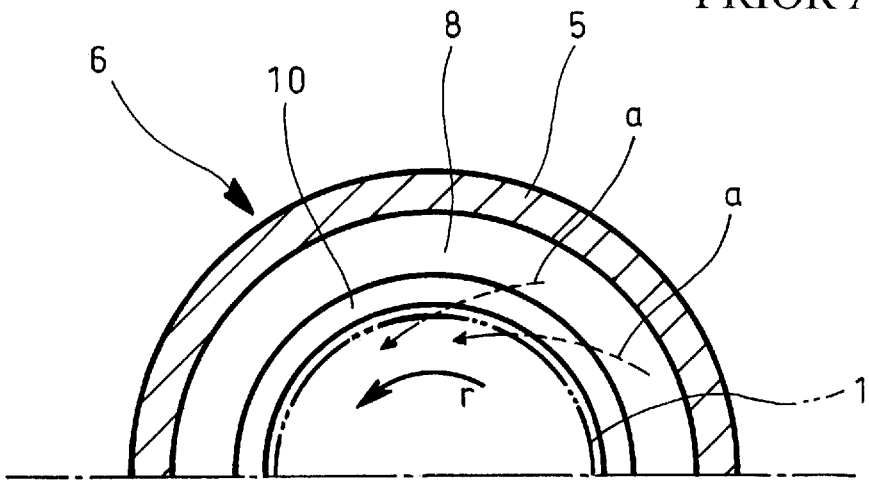
FIG. 2B PRIOR ART
FIG. 2B is a view looking in the direction of arrow 2B in FIG. 2A.
Figure 3A:
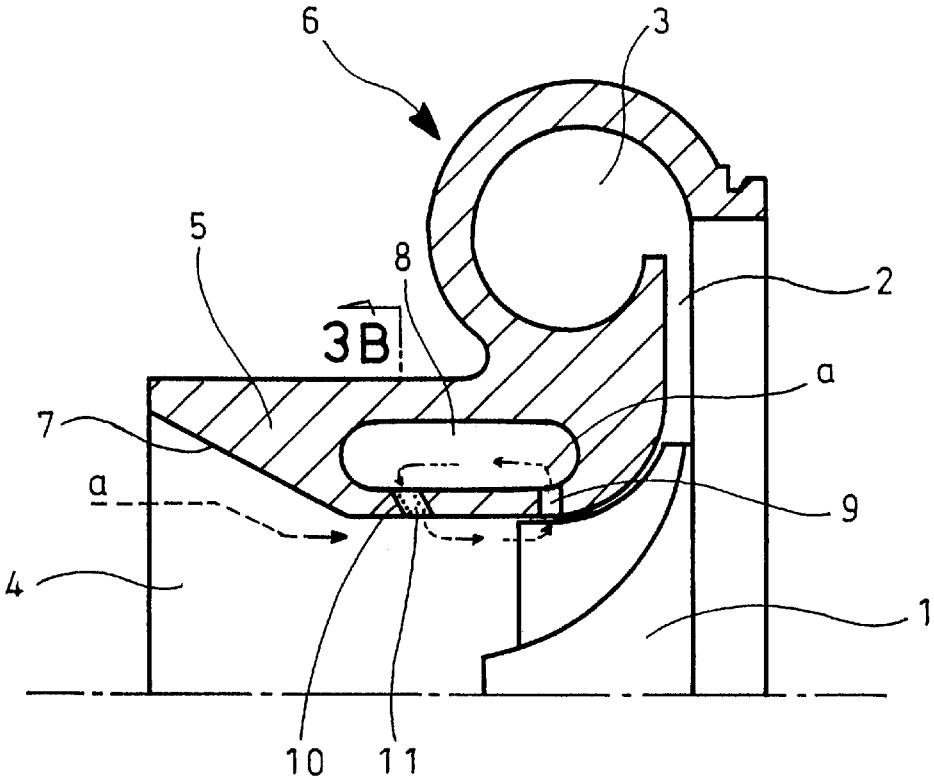
FIG. 3A is a schematic fragmentary sectional side elevation illustrating an embodiment of the invention.
Figure 3B:
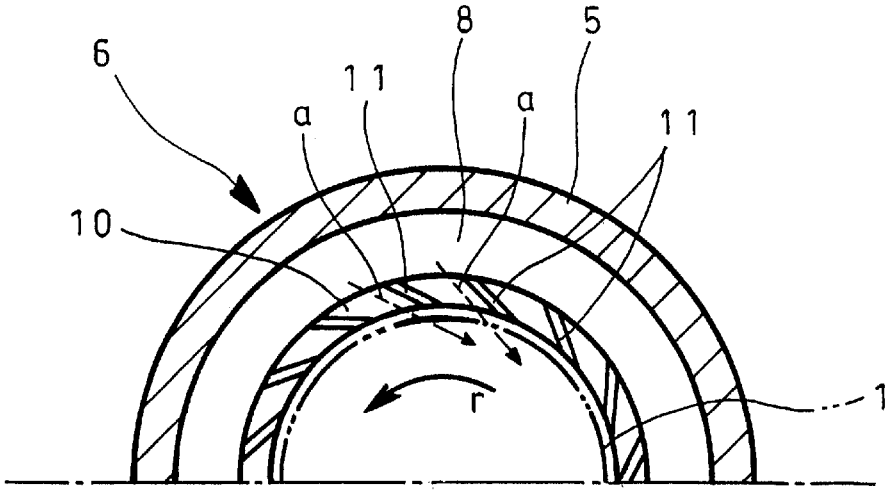
FIG. 3B is a view looking in the direction of arrow 3B in FIG. 3A.

FIGS. 3A and 3B illustrate an embodiment of the inventions. In the apparatus for expanding an operating range of a centrifugal compressor which is similar in basic construction to the prior apparatus shown in FIGS. 2A and 2B, a second opening 10 on a shroud wall 5 is directed to the impeller 1 and has a number (for example, 6 to 22 pieces) of louvers 11 arranged in the opening 10 in circumferentially spaced apart relationship from each other. More specifically, the louvers 11 are arranged in the opening 10 at circumferentially equidistantly or arbitrarily spaced intervals such that they are inclined (for example at about 65°) reversely to the rotative direction of the impeller. It is to be noted that, in FIGS. 3A and 3B, the same elements found also in FIGS. 2A and 2B are identified with the same reference numerals.

During a low-flow-rate operation, part of the air a that has passed through the impeller 1 under the pressure raised by the impeller 1, passes through the first opening 9 into the treatment cavity 8. During travel in the treatment cavity 8 toward the second opening 10, the air a is whirled in the same direction as the rotative direction of the impeller 1. Then, now that the second opening 10 has the louvers 11 disposed therein in angular arrangement inclined reversely to the rotative direction of the impeller 1, the air a is subjected to the directional guide action exerted by the louvers 11 during passage through the second opening 10 to the entry side of the impeller 1. As a result, the air is discharged as a flow having a direction reverse to the rotative direction of the impeller 1. Accordingly, expansion of the operating range of the centrifugal compressor can be successfully attained with no decrease in the Euler head.

Figure 4A:
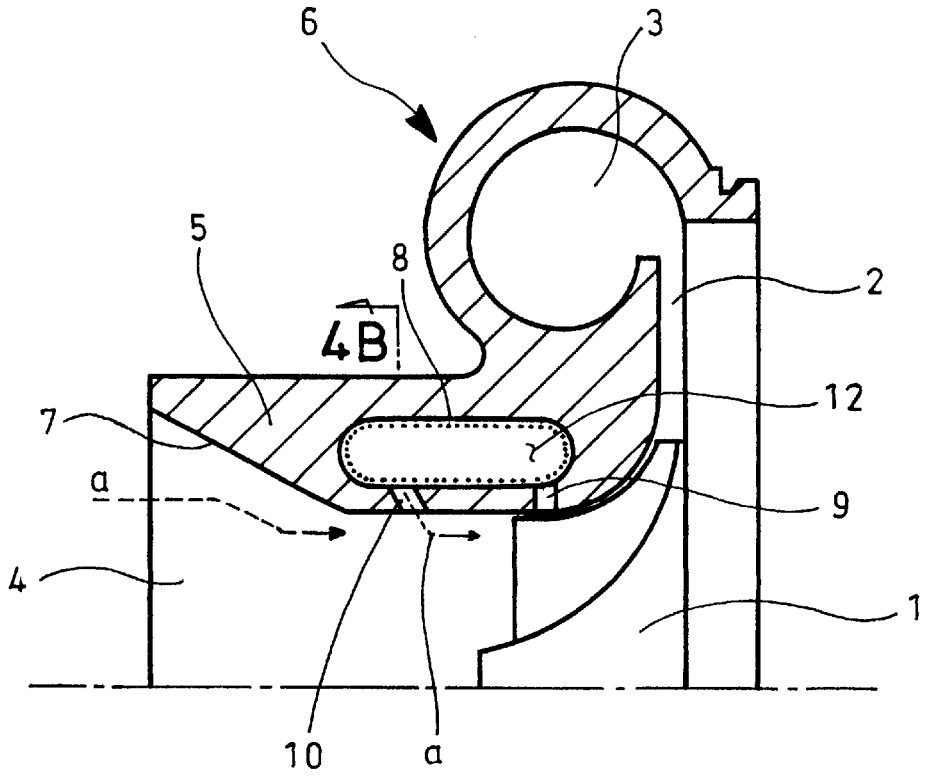
FIG. 4A is a schematic fragmentary sectional side elevation illustrating a further embodiment of the invention.
Figure 4B:
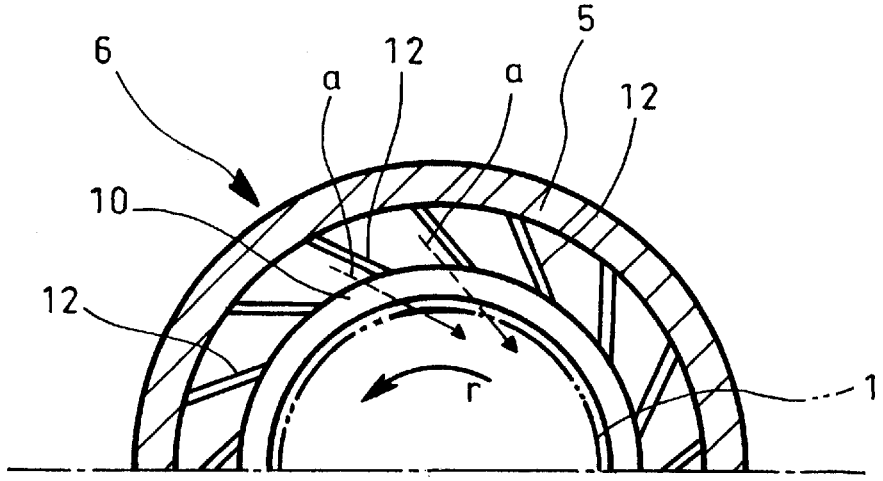
FIG. 4B is a view looking in the direction of arrow 4B in FIG. 4A.

FIGS. 4A and 4B illustrate a further embodiment of the invention. In an apparatus for expanding an operating range of a centrifugal compressor that is similar in construction to that shown in FIGS. 3A and 3B, instead of disposing the louvers 11 in the second opening 10, a number (for example, 6 to 22 pieces) of guide plates 12 are disposed in the treatment cavity 8 in circumferentially spaced apart relationship from each other. More specifically, the guide plates 12 are arranged in the treatment cavity 8 at equidistantly or arbitrarily spaced intervals such that they are inclined reversely (for example, at about 65°) to the rotative direction of the impeller 1.

Figure 1:
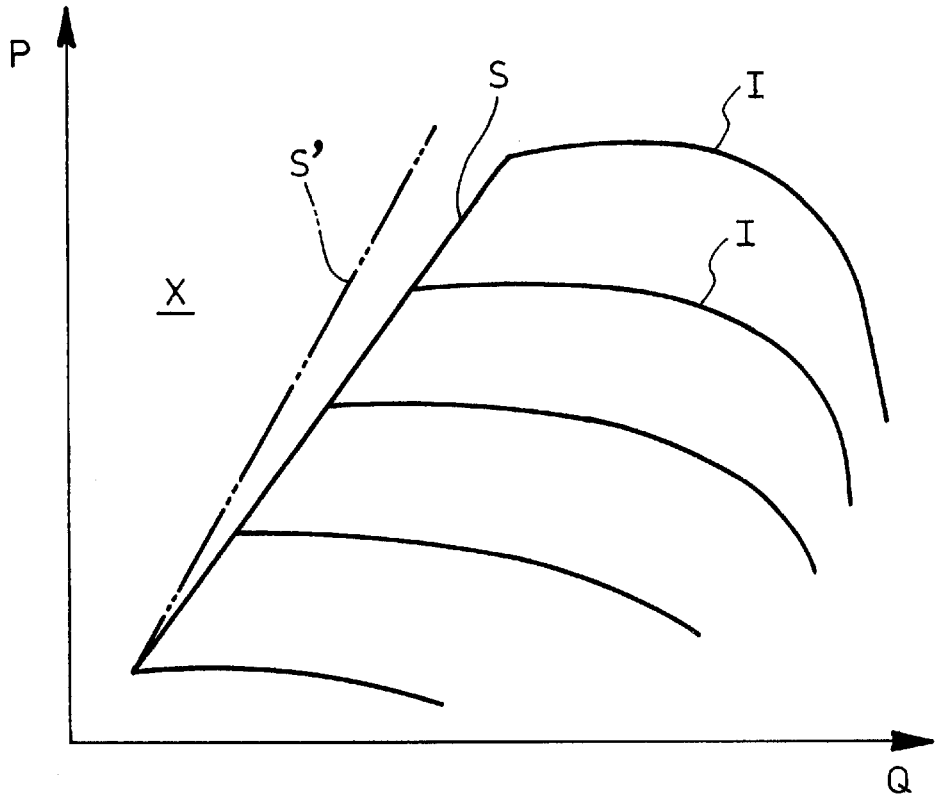
F I G. 1 PRIOR ART
FIG. 1 is a diagram illustrating the relationship between flow rate and pressure in a conventional centrifugal compressor.
Figure 5:
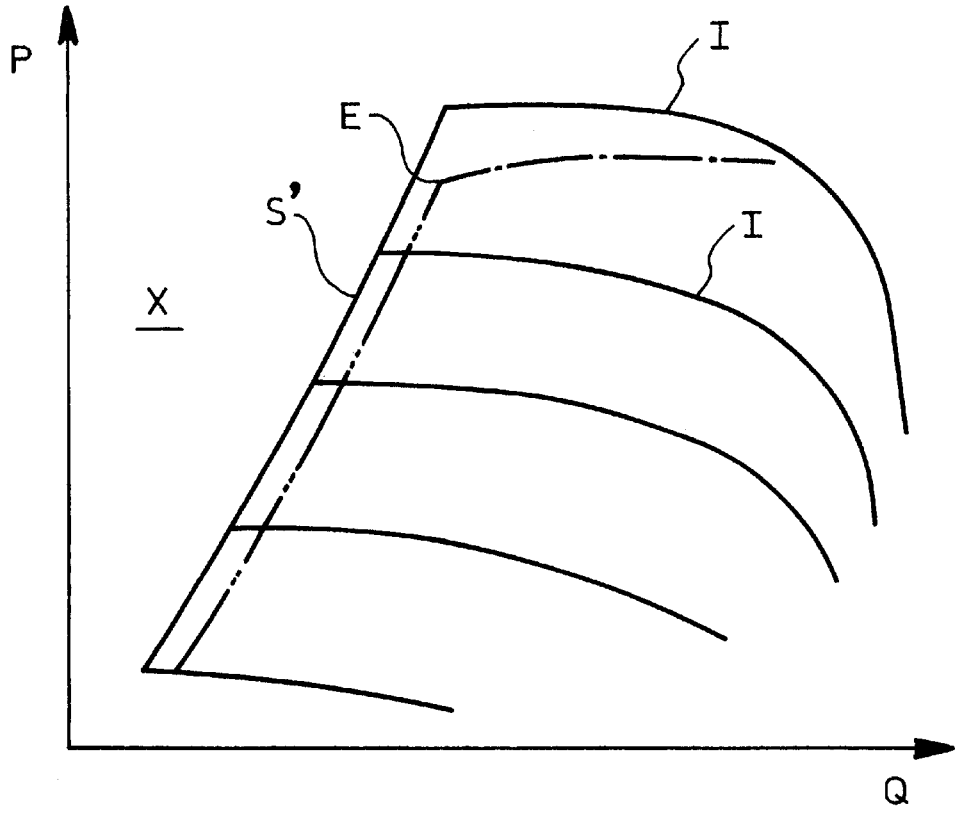
FIG. 5 is a diagram illustrating the relationship between flow rate and pressure in a centrifugal compressor according to the further embodiment shown in FIGS. 4A and 4B.

In the structure shown in FIGS. 4A and 4B, the air a sucked in the treatment cavity 8 through the first opening 9 is not only restrained from flowing in the forward direction to the rotative direction of the impeller 1 by the guide plates 12 each having an area larger than the louver 11 shown in FIGS. 3A and 3B, but also is subjected to directional flow guide action by the same guide plates 12 so as to flow in a whirling direction reverse the rotative direction of the impeller 1. As a result, the air a is discharged through the second opening 10 as a flow with strong directivity reverse to the rotative direction of the impeller 1. Accordingly, in comparison with the embodiment shown in FIGS. 3A and 3B, the Euler head can be stabilized further securely and thus expansion of the operating range of the centrifugal compressor can be attained further expansively. In the case where the guide plates 12 axe disposed in the treatment cavity 8 so as to be inclined in a direction reverse to the rotative direction of the impeller 1 as shown in FIGS. 4A and 4B, as is understood from FIG. 5, the surge line can be shifted (just like in FIG. 1) to the position S' where the flow rate is low, and so, the compressor's characteristic curve I can be shifted above with respect to the operation line E for the engine. This contributes to ensuring a further stable operating condition.

Figure 6A:
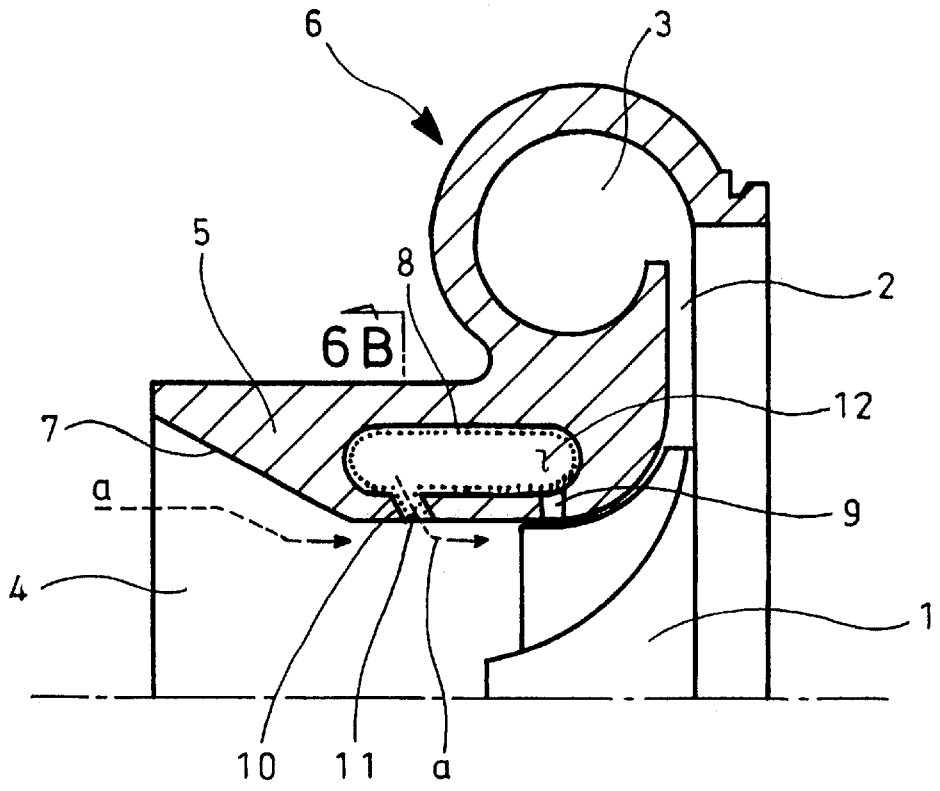
FIG. 6A is a schematic fragmentary sectional side elevation illustrating a still further embodiment of the invention.
Figure 6B:
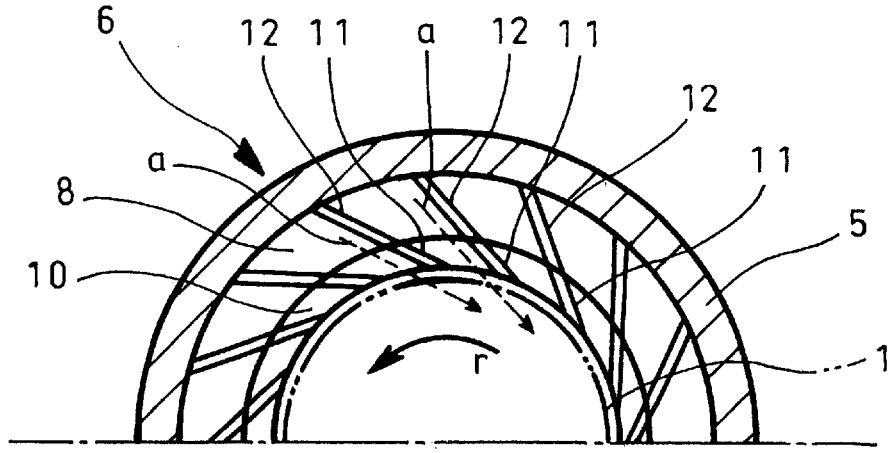
FIG. 6B is a view looking in the direction of arrow 6B in FIG. 6A.

FIGS. 6A and 6B illustrate a still further embodiment of the invention. In the apparatus for expanding the operating range of the centrifugal compressor that is similar in construction to that shown in FIGS. 3A and 3B, guide plates 12 are disposed in the treatment cavity 8 as if to be extended from their corresponding louvers 11. That is, the guide plate 12 are integrally aligned with the corresponding louvers 11.

In the structure shown in FIGS. 6A and 6B, the circulating air a is subjected to directional flow guide action by the guide plates 12 in the treatment cavity 8 and then, during passage through the second opening 10, is further subjected to the directional flow guide action exerted by the louvers 11. As a result, the air a is discharged through the second opening 10 as a flow with further strong directivity in a direction reverse to the rotative direction of the impeller 1. Accordingly, obtained are effects and advantages equivalent or superior to as achieved in the previously-described embodiments.

Figure 7A:
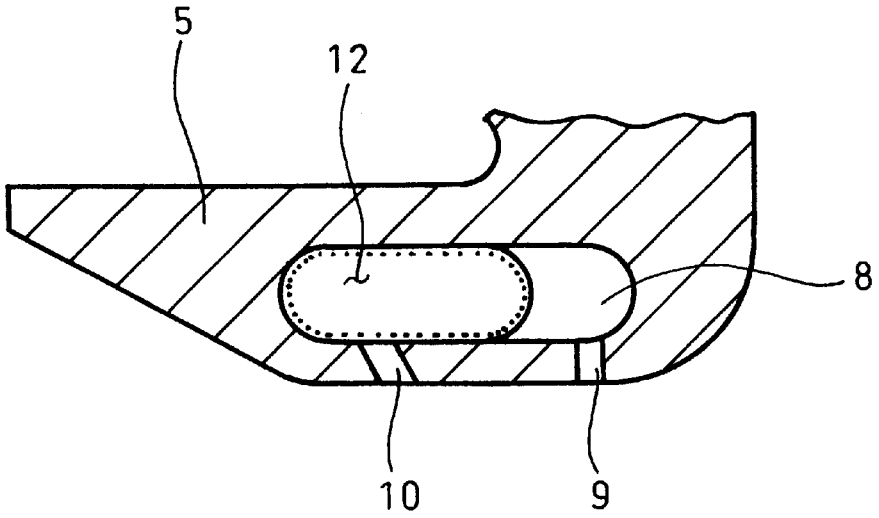
FIG. 7A is a side view illustrating a modification of the guide plate.
Figure 7B:
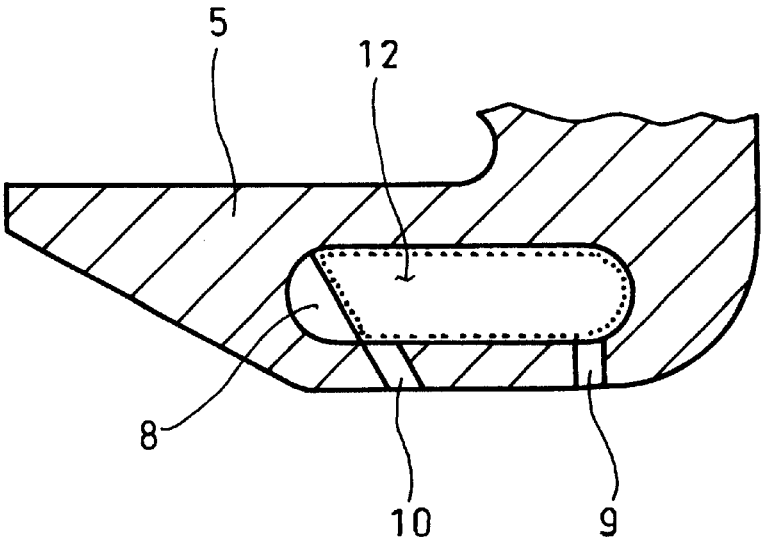
FIG. 7B is a side view illustrating a further modification of the guide plate.

FIGS. 7A and 7B illustrate modifications of the guide plates 12 employed in the embodiment shown in FIGS. 4A and 4B (or FIGS. 6A and 6B). The guide plates 12 shown in the figures halve their width dimension short of the axial length of the treatment cavity 8. The guide plate 12 shown in FIG. 7A is so designed that its one end does not reach an inner edge of the treatment cavity 8 adjacent to the first opening 9. On the other hand, the guide plate 12 shown in FIG. 7B is so designed that its other end does not reach an inner edge of the treatment cavity 8 adjacent to the second opening 10.

Either of the guide plates 12 shown in FIGS. 7A and 7B will allow the air a to be discharged through the second opening 10 as flow in a whirling direction reverse to the rotative direction of the impeller 1.

It is to be understood that the present invention is not limited to the above-mentioned embodiments and that various changes and modifications may be made without departing from the scope and spirit of the invention. For example, though the embodiments described above deal only with the louvers 11 and/or guide plates 12 inclined reversely to the rotative direction of the impeller 1, they may be arranged radially (0°) so that air is discharged through the second opening 10 as flow with a direction having no whirling component toward the center of the rotation axis. In the reversely inclined arrangement of the louvers 11 and/or guide plates 12, the inclination angle is preferably set to at most 70° since stabilization effects upon the Euler head remain unchanged even if the inclination angle is set to be over 70°. Though the embodiments described above are only directed to a centrifugal compressor with a throttle portion 7 adjacent to an air inlet 4, the invention may be also applicable to a centrifugal compressor with no throttle portion.

As described heretofore, according to the invention, there is provided a method for expanding an operating range of a centrifugal compressor, the centrifugal compressor including a shroud wall extending ahead of an outer periphery of an impeller to provide an air inlet, an annular treatment cavity in the shroud wall and first and second openings on the shroud wall, the first opening providing communication between the treatment cavity and the impeller-side portion of the air inlet, the second opening providing communication between the treatment cavity and a portion of the air inlet located somewhat ahead of the impeller-side portion of the air inlet, wherein, during a low-flow-rate operation, part of the air sucked through the impeller is fed through the first opening into the treatment cavity and is discharged through the second opening so as to be circulated. The method comprises discharging the air, which has flowed through the first opening into the treatment cavity, through the second opening as flow having a direction within a range from a direction with no whirling component to a whirling direction reverse to the rotative direction of the impeller. There is also provided an apparatus for expanding an operating range of a centrifugal compressor, the centrifugal compressor including a shroud wall extending ahead of an outer periphery of an impeller to provide an air inlet, an annular treatment cavity in the shroud wall and first and second openings on the shroud wall, the first opening providing communication between the treatment cavity and the impeller-side portion of the air inlet, the second opening providing communication between the treatment cavity and a portion of the air inlet located somewhat ahead of the impeller-side portion of the air inlet, wherein, during a low-flow-rate operation, part of the air sucked through the impeller is fed through the first opening to the treatment cavity and is discharged through the second opening so as to be circulated. The apparatus comprises a number of louvers arranged in the second opening of the shroud wall, the arrangement of the louvers being within a range from radial arrangement to arrangement inclined reversely to the rotative direction of the impeller. As a result, the air is, when discharged through the second opening, subjected to directional flow guide action by the louvers within a range from a direction with no whirling component to a whirling direction reverse to the rotative direction of the impeller. This makes it possible to achieve expansion of the operating range with no decrease in the Euler head. Instead of the louvers in the second opening, a number of guide plates may be arranged in the treatment cavity, the angular arrangement of the guide plates being within a range from radial arrangement to arrangement inclined reversely to the rotative direction of the impeller. In this alternative structure, the air can be subjected to directional flow guide action, in the relatively wide area of treatment cavity, within a range from a direction with no whirling component to a whirling direction reverse to the rotative direction of the impeller. As a result, air is discharged through the second opening as flow with strong directivity not aligned with the rotative direction of the impeller, thereby stabilizing the Euler head. Alternatively, the guide plates may be disposed in the treatment cavity as if to be integrally extended from their corresponding louvers. In this structure, the circulating air can be subjected to the directional flow guide action continuously exerted by the guide plates and by the louvers, within a range from a direction with no whirling component to a whirling direction reverse to the rotative direction of the impeller. As a result, the air is discharged through the second opening as flow with further strong directivity, thereby further stabilizing the Euler head.

What is claimed is:

1. A method for expanding an operating range of a centrifugal compressor, the centrifugal compressor including a shroud wall extending ahead of an outer periphery of an impeller to provide an air inlet, an annular treatment cavity in the shroud wall and first and second openings on the shroud wall, the first opening providing communication between the treatment cavity and an impeller-side portion of the air inlet, the second opening providing communication between the treatment cavity and a portion of the air inlet located upstream of the impeller-side portion of the air inlet, wherein, during a low-flow-rate operation, part of the air sucked through the impeller is fed through the first opening into the treatment cavity and is discharged through the second opening so as to be circulated, the method, comprising:

feeding air into the treatment cavity so as to have a flow within a range from a direction with no whirling component to a whirling direction reverse the rotative direction of the impeller; and discharging the air, which has flowed through the first opening into the treatment cavity, through the second opening as a flow having a direction within a range from a direction with no whirling component to a whirling direction reverse to the rotative direction of the impeller.

2. An apparatus for expanding an operating range of a centrifugal compressor, the centrifugal compressor including a shroud wall extending ahead of an outer periphery of an impeller to provide an air inlet, an annular treatment cavity in the shroud wall and first and second openings on the shroud wall, the first opening providing communication between the treatment cavity and an impeller-side portion of the air inlet, the second opening providing communication between the treatment cavity and a portion of the air inlet located upstream of the impeller-side portion of the air inlet, wherein, during a low-flow-rate operation, part of the air sucked through the impeller is fed through the first opening to the treatment cavity and is discharged through the second opening so as to be circulated, the apparatus comprising a number of louvers arranged in the second opening of the shroud wall, an angular arrangement of the louvers being within a range from a radial arrangement to an arrangement inclined reversely with respect to the rotative direction of the impeller.

3. An apparatus according to claim 2, wherein the guide plates arranged in the treatment cavity as arranged so as to extend from their corresponding louvers.

4. An apparatus for expanding an operating range of a centrifugal compressor, the centrifugal compressor including a shroud wall extending ahead of an outer periphery of an impeller to provide an air inlet, an annular treatment cavity in the shroud wall and first and second openings on the shroud wall, the first opening providing communication between the treatment cavity and an impeller-side portion of the air inlet, the second opening providing communication between the treatment cavity and a portion of the air inlet located upstream of the impeller-side portion of the air inlet, wherein, during a low-flow-rate operation, part of the air sucked through the impeller is fed through the first opening to the treatment cavity and is discharged through the second opening so as to be circulated, the apparatus comprising a plurality of guide plates arranged in the treatment cavity, an angular arrangement of the guide plates being within a range from radial arrangement to arrangement inclined reversely to the rotative direction of the impeller.

* * * * *